United States Patent [19]

Koide et al.

[11] 4,008,545

[45] Feb. 22, 1977

[54] MACHINE FOR PREWORKING OVERLAPPING ABRASIVE COATED BELT JOINT

[75] Inventors: Sakae Koide, Tokyo; Masatoshi Ishii, Inagi; Yukiharu Yamamoto, Tokyo, all of Japan

[73] Assignee: Tajara Shoyei Kiko K.K., Tokyo, Japan

[22] Filed: Feb. 10, 1976

[21] Appl. No.: 656,801

[30] Foreign Application Priority Data

June 10, 1975 Japan ..... 50-70035

[52] U.S. Cl. ..... 51/5 C; 51/81 R; 51/140; 156/509; 156/510; 156/535

[51] Int. Cl.[2] ..... B24B 7/02; B32B 31/04

[58] Field of Search ..... 51/5 B, 5 C, 40, 80 R, 51/81 R, 111 R, 140; 156/153, 502, 509, 510, 535

[56] References Cited

UNITED STATES PATENTS

| | | | |
|---|---|---|---|
| 2,661,579 | 12/1953 | Lomazzo | 51/5 C X |
| 2,794,726 | 6/1957 | Riedesel | 156/153 X |
| 3,058,868 | 10/1962 | Schroeder | 156/153 |
| 3,269,065 | 8/1966 | Nylund | 51/139 |
| 3,336,700 | 8/1967 | Kuzmik | 51/5 B |
| 3,633,319 | 1/1972 | Maag | 51/140 X |
| 3,654,735 | 4/1972 | Gentile | 51/5 C |

*Primary Examiner*—Gary L. Smith
*Attorney, Agent, or Firm*—Fleit & Jacobson

[57] ABSTRACT

A machine for preworking overlapping abrasive coated joint comprising original roll unit, cutting and working unit, and slit unit sections. The cutting and working unit section has a horizontal table 9 having a knife blade 21 attached to its forward end. First and second flaps are swivellably mounted on said cutting and working section by means of a shaft in such a way that their end portions are brought to the position flush with said knife edge and in contact therewith. A belt material hold down roller is disposed on the top surface of said second flap. In the cutting and working unit section, an upper working unit and a lower working unit are disposed above and below said horizontal table. The upper working unit having a circular cutter for cutting the grinding belt material, a grinding wheel for skiving, and a shaving grinding belt for pointing the upper end surface of the grinding belt material. The lower working unit having a shaving grinding belt for pointing the lower end surface of the grinding belt material which is being pinched between said second flap and a pointing plate.

1 Claim, 5 Drawing Figures

MACHINE FOR PREWORKING OVERLAPPING ABRASIVE COATED BELT JOINT

BACKGROUND OF THE INVENTION

The present invention relates to a machine for preworking overlapping abrasive coated belt joint which is primarily intended for preworking the overlapping joint of other endless belts as well as ordinary belts.

Therefore, although in the following descriptions a case of preworking overlapping joint of endless abrasive coated belts (hereinafter called grinding belt) is taken up as an example, it should be understood that the present invention is not limited to this application, but can be applied to many other cases of preworking overlapping joint of a wide variety of belts as well.

In the case of grinding belts, original products supplied by grinding belts manufacturers are in the form of rolls of long and wide grinding belts, hereinafter referred to as original rolls. These original rolls therefore have to be cut to appropriate lengths and widths, and then, the two ends of these cut grinding belts pieces have to be overlapped together to form endless belts, either prior to their retail sale or prior to their use on grinding machines in which they are applied around the pulleys for the purpose of grinding various workpieces.

In overlapping the two joints of grinding belt pieces cut to appropriate sizes, normally, the two ends are lapped one above the other, and bonded under pressure with the use of adhesive, but for this, the two end portions must be properly preworked.

DESCRIPTION OF THE PREFERRED EMBODIMENT OF THE INVENTION

Figure 1:
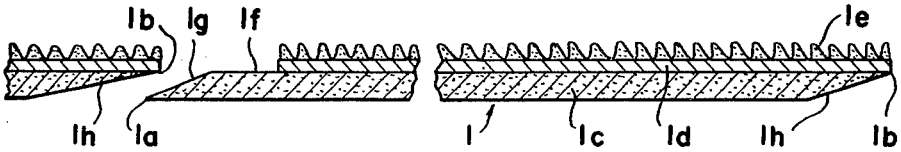
FIG. 1 is a sectional view of a grinding belt.

Referring now to FIG. 1, a piece of grinding belt 1 cut to a predetermined length is shown with its leading end 1*a* and its trailing end 1*b*. When seen from above, these two end edges are not at right angle but at 45° to 60° to the length direction. The grinding belt is shown to consist of the basic cloth 1*c*, the adhesive layer 1*d*, and the grinding grit layer 1*e*. At the leading end 1*a* of the grinding belt piece 1, the grinding grit layer 1*e* and the adhesive layer 1*d* are removed for a short length to make a skiving surface 1*f*, and furthermore, along the end edge, the basic cloth is shaved to form an upper pointing surface 1*g*, while at the trailing end 1*b*, the basic cloth is shaved to form a lower pointing surface 1*g*. To loop a piece of grinding belt 1 having been preworked in this way, and to lap and bond the two ends securely with adhesive, with the trailing end 1*b* lapping over the skiving surface 1*f*, and the upper pointing surface 1*g* lapping over the skiving surface 1*f* and the lower pointing surface 1*h* is the common method of obtaining an endless grinding belt.

However, in conventional methods, to obtain a piece of cut grinding belt of which the two ends are preworked into the shapes as shown above in preparation for the following bonding process, the following five processes are required. (1) cutting unwound original roll grinding belt material either manually or semi-automatically at 45° to 60° to the length direction into a predetermined length, (2) skiving the leading end portion (removing grinding grit), (3) shaving the upper side of the basic cloth at the leading end to form an upper pointing surface, (4) shaving the bottom side of the basic cloth at the trailing end to form a lower pointing surface, and (5) finally, slitting the material into narrow belt pieces of a predetermined width; whereby the above processes (1) through (5) are being performed independently.

Therefore, in conventional processes, not only the belt joint preworking process are extremely low in efficiency, but also, when processing grinding belt material which is tough and which has tenacious curling tendency, the work is extremely difficult.

The present invention comprises an improvement of the conventional processes to eliminate these shortcomings, providing a labor-saving machine capable of continuously and efficiently performing the above processes (1) through (5).

In a machine based on the present invention, a long horizontal table, over which grinding belt material unrolled from an original roll is pulled out, is disposed across a cutting and working unit section, a knife blade is disposed across said horizontal table at 45° or 60° to the longitudinal direction of said horizontal table in the plane thereof, and a working slide reciprocally moving parallel to said knife blade carrying a circular blade for cutting the grinding belt material, a grinding wheel for skiving, a belt grinder for upper surface pointing, and another belt grinder for lower surface pointing is so disposed that in the forward travel of said working slide, the grinding belt material is cut, skived, shaved on the upper surface, and in the return travel thereof, it is shaved on the lower surface.

Below, a preferred embodiment of the present invention will be described in more detail making reference to FIGS. 2, 3, 4, and 5.

Figure 3:
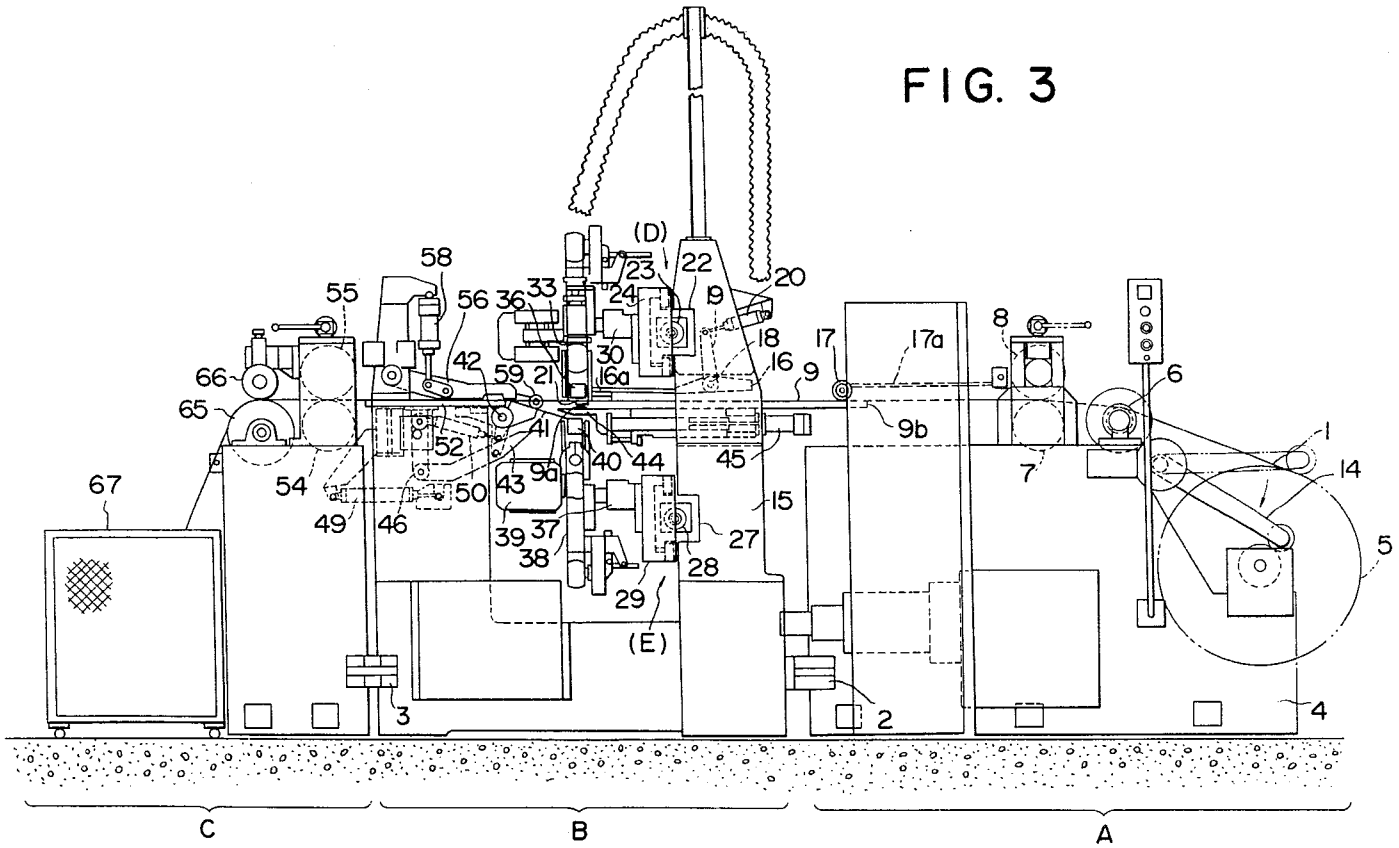
FIG. 3 is a side view of the machine shown in FIG. 2.

As can be best seen in FIG. 3, the entire machine is divided into three major sections, the original roll unit section A, the cutting and working unit section B, and the slit unit section C, the three sections being connected by means of joint brackets 2 and 3.

Figure 4:
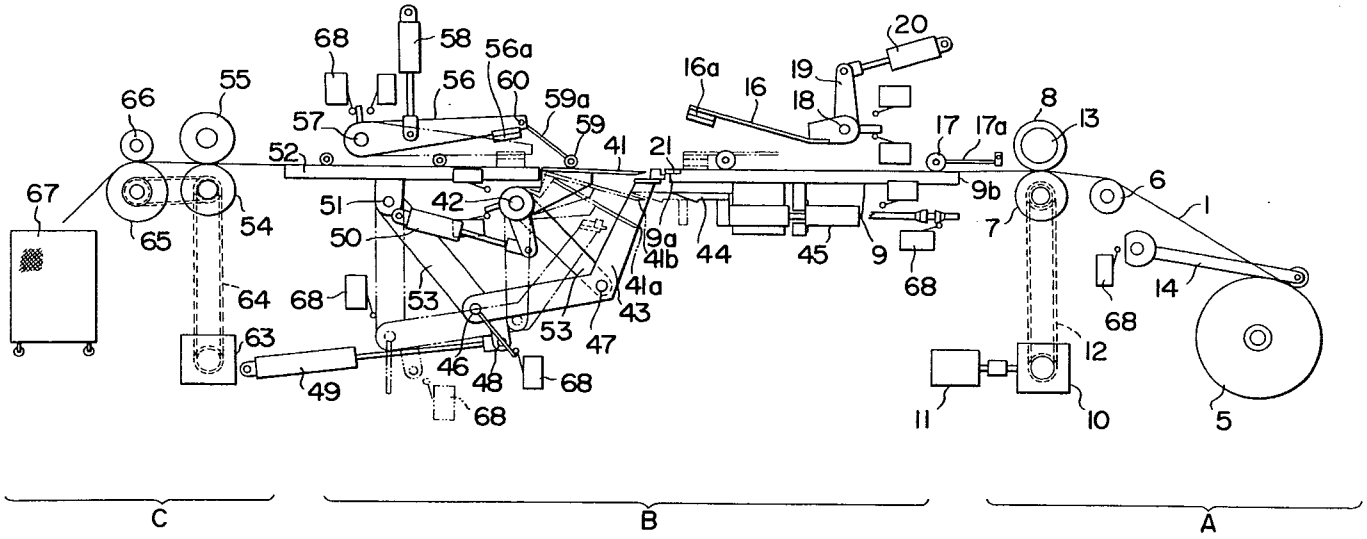
FIG. 4 is a schematic side view of the machine showing the working principle of the principal members of the machine, without the upper and the lower working units in the cutting and working unit section.

Referring now to FIG. 4 in addition to FIG. 3, in said original roll unit section A, at the end of the frame 4, an original roll 5 is supported with a shaft, and the grinding belt material 1 unrolled therefrom is first guided by the guide roll 6, then, pulled between the first drive roll 7 and the first measuring roll 8, then, moves over the horizontal table 9, then moves across the cutting and working unit section B and the slit unit section C, and comes to a temporary stop. The first drive roll 7 is driven through the chain 12 by the speed reducer 10, which is coupled to the drive motor 11 with a coupling. Said first measuring roll 8 is equipped with the pulse generator 13 so as to be able to measure the length of the grinding belt material 1 being unrolled from the original roll 5. The arm 14 is for detecting the completely unrolled condition of the original roll 5.

The unwound grinding belt material 1 pulled out of the original roll unit section A is thus pulled over the horizontal table 9 and is finally brought to a stop while lying over it. Said horizontal table 9 has the forward end 9*a* and the rear end 9*b* and is fastened to and projecting from the cutting and working unit section B. Over the rear end 9*b*, there is disposed the grinding belt material holding down roll 17 rotatably supported by the arm 17*a*.

In the cutting and working unit section B, on both sides of the horizontal table 9, there are disposed a machine frame member 15. Because the grinding belt hold down member 16 is swivelably supported by the pivot pin 18 and has a rocking arm 19 which is pushed by the cylinder 20 through a piston rod, the forward end 16*a* of said hold down member 16 is always positioned in a close proximity of the forward end 9*a* of the horizontal table 9. At said forward end 9*a* of the horizontal table 9, at an angle of 60° to the travel direction of the grinding belt 1, the knife blade 21 is fastened.

Between said right and left frame members 15 (of which only one is shown), the working units D and E are disposed, one above and the other below the horizontal table 9, and these working units D and E are capable of making reciprocal traverse motions across the horizontal table 9, one moving above and the other moving below said table but always maintaining a synchronous relationship between them because they are both driven by a common drive motor as described in more detail later. With respect to the upper working unit D, between the right and left machine frame members 15, the frame rail 22 is installed, with the feed screw 23 installed thereinside and the slide base 24 slidably but unremovably mounted thereon, whereby said slide base is driven in forward and backward sliding movement by said feed screw 23 rotating clockwise and counter-clockwise. The accordion cover 25 is for dust protection. While said feed screw 23 is driven by the motor 26 which is arranged to run in both directions, mounted at one end of the frame rail 22, this motor also drives the feed screw 28 installed inside the frame rail 27 for the lower working unit E through a belt, so that when this motor runs, not only the slide base 24 of the upper working unit D is driven in sliding movement, but also the slide base 29 slidably but unremovably mounted on the lower frame rail 27 and in threading engagement with said feed screw 28 is driven in sliding movement in exact synchronization with said slide base 24.

Figure 5:
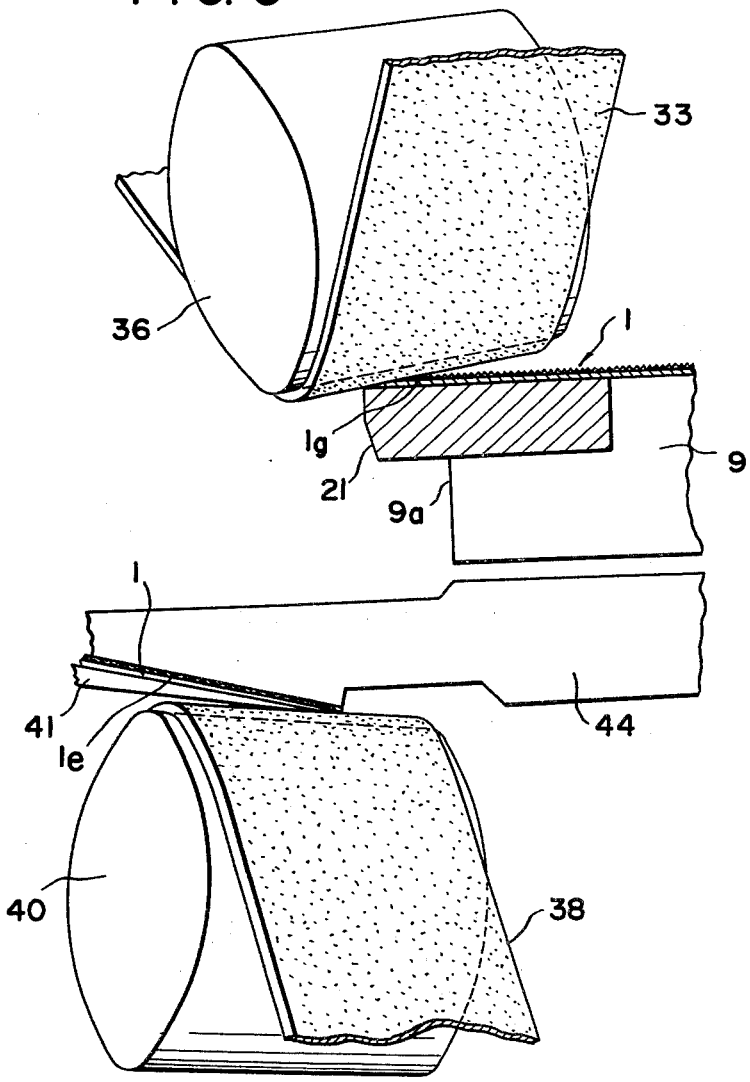
FIG. 5 shows the working principle of the pointing processes on the upper side and on the lower side of the grinding belt material in enlargement.
Figure 2:
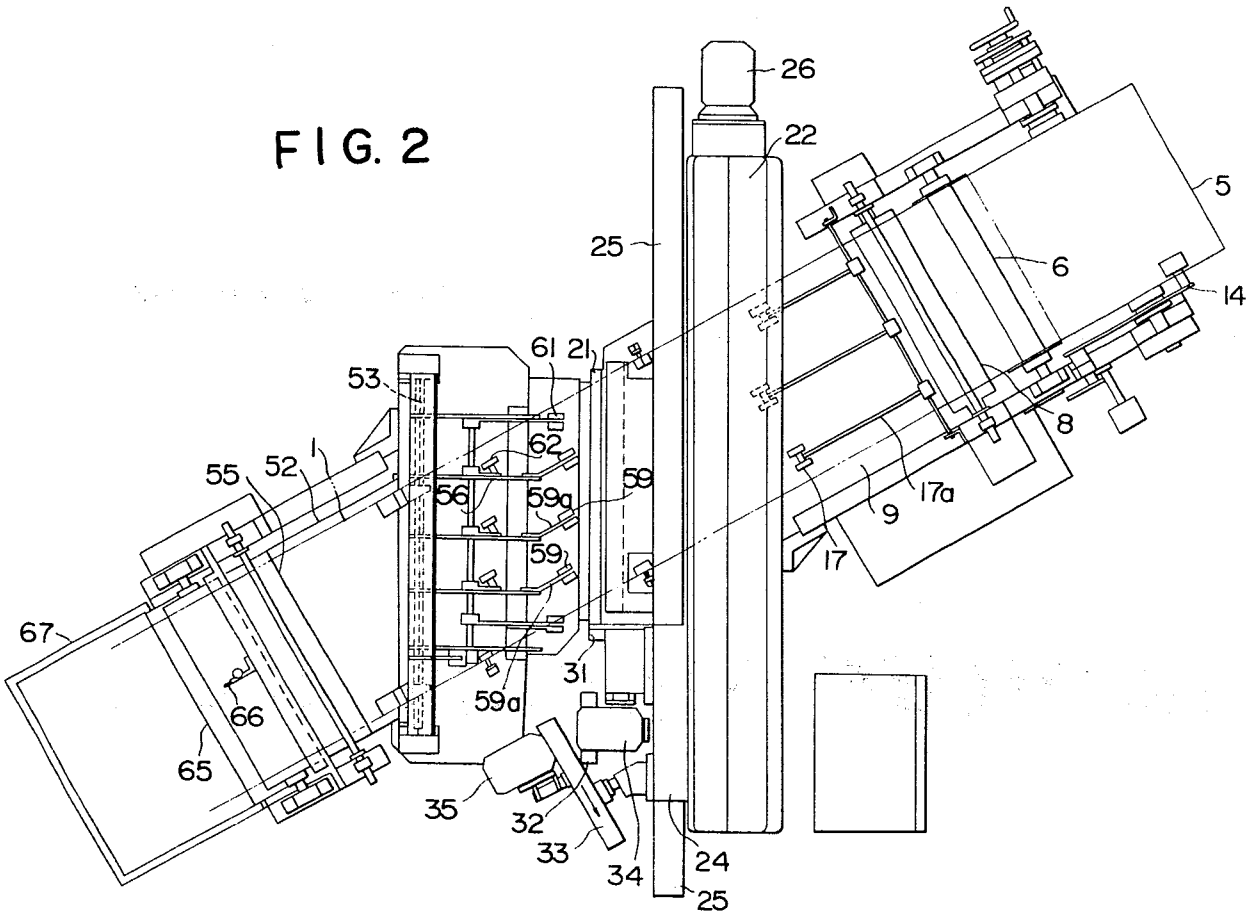
FIG. 2 is a plan view of a machine based on the present invention.

Said upper slide base 24 carries thereon the arm 30, and on this arm 30, the circular cutter 31 for cutting the grinding belt, the grinding wheel 32 for skiving, and the shaving grinding belt 33 for upper surface shaving are mounted, being arranged in the above order towards the rear of the slide base. This circular cutter 31 is rotatably mounted on the slide base 24 in slight shearing engagement with said knife blade 21 fastened to the forward end 9*a* of the horizontal table 9, so that when the slide base 24 moves forward, it moves rotatingly forward with it, cutting the grinding belt between it and the knife blade 21. Immediately behind this circular cutter 31, the grinding wheel 32 driven in rotation by the drive motor 34 moves foward, skiving the top layers of the grinding belt in the neighborhood of the cut end. The shaving grinding belt 33 is applied around several pulleys including a driving pulley driven by the drive motor 35 mounted on a pulley support frame installed on the slide base 24, and a contact wheel, so that when the slide base moves forward, this shaving grinding belt 33 shaves the upper surface of the grinding belt material in the immediate neighborhood of the cut end. As shown in FIG. 2, where the shaving grinding belt 33 is shown in its top view, it is driven in the direction indicated by the arrow. In FIG. 5, the bevel shaving principle of the shaving grinding belt 33 is schematically shown in enlargement. Here, although the contact wheel 36 is shown in appreciable inclination, in actual operation, it is required to be inclined only slightly.

As described above, when the upper working unit D is made to move forward across the horizontal table once, the grinding belt material 1 is completely worked as far as its upper surface is concerned, that is, it is cut, skived, and shaved on the upper surface. The simultaneous performance of these three processes in this way is a comparatively simple problem in mechanism. When it is intended to complete the fully automatic working cycle by allowing the lower side of the grinding belt material to be shaved while the working units moves backward, very difficult problems in mechanism come up, but they are solved in the present invention as follows.

In the lower working unit E, the slide base 29 has the arm 37 on which the shaving grinding belt 38 is installed for shaving the lower surface of the grinding belt material 1 similar to the shaving grinding belt 33 for shaving the upper surface. As this shaving grinding belt 38 is applied around a plurality of pulleys including a driving pulley driven by the drive motor 39 and the contact wheel 40, said all pulleys and said contact wheel installed on a pulley support frame installed on said slide base 29, during the return movement of the working unit E, this shaving grinding belt 30 being backed up by said contact wheel 40 makes contact with the lower side of the grinding belt material 1, and shaves its lower surface in the neighborhood of the trailing end to form a pointing surface. Because this contact wheel 40 is located underneath the forward end 9*a* of the horizontal table 9 at a small distance therefrom, during the forward movement of said two working units, it moves forward underneath the grinding belt material 1 at small distance where it does not interfere with the cutting, skiving and upper surface pointing processes, but during the return movement of the working unit E, the trailing end portion of the cut grinding belt material 1 found immediately forward of the cut line just made comes down together with the second flap 41, to be described fully later, to the position shown in dash line in FIG. 4, and is shaved by the shaving grinding belt 38.

To be described in detail, said second flap 41 is swivellably installed by the pivot pin 42, and whenever it makes a swivel motion, the first flap 43 makes a movement in certain sequence with it to the position indicated in dash line in FIG. 4 for the purpose and by the mechanism to be described later. When said second flap 41 comes down to its lowest position 41*a*, the pointing plate 44 which is slidably mounted underneath the horizontal table 9, horizontally pushed and pulled by the cylinder 45 installed on the lower side of the horizontal table 9 and located at the side of said second flap 41 advances to the position shown in dash line in FIG. 4, and then, the second flap 41 together with the trailing end of the cut grinding belt material 1 mounted on it moves up from its lowest position 41*a* to the middle position 41*b* thereby pinching the trailing end 1*b* of the grinding belt material 1 between itself and the pointing plate 44. This pinched condition of the trailing end 1*b* is shown in detail in FIG. 5 in which the trailing end of the grinding belt material 1 is seen to be backed up by the pointing plate 44 from above, and to project slightly from the end of the second flap 41. This projecting portion makes contact with the shaving grinding belt 38 guided by the contact wheel 40 and is shaved by it. When this shaving process is over, the pointing plate 44 is retracted, and the second flap 41 returns to its horizontal position.

Both the first flap 43 and the second flap 41 are swivellably mounted at the end of the cutting and working unit section B by means of the shaft 42. The second flap 41 is actuated by the cylinder 50, while the first flap 43 is swivellably connected at two points to the end of the arm 53 swivellably connected to the lower side of another horizontal table 52 by means of the pivot pin 51 and the end of the arm 53 swivellably supported by said shaft 42, and is actuated by the cylinder 49, in such a way that while the upper and the lower working units D and E are moving across the horizontal table, cutting and working the grinding belt material 1, said first flap 43 is located as shown in FIG. 4 in dash line out of the way of the travelling drive motor 39 of the lower working unit E. The reason for providing the machine with this first flap 43 is to fill the gap between the knife blade 21 fastened to the forward end 9*a* of the horizontal table 9 and the end of the second flap 41 during the time the completely preworked grinding belt material is transported forward into the slit unit section C, because if said gap is left unfilled during this time, the leading end of the next grinding belt material 1 is apt to move into said gap rather to move over to the top surface of the second flap 41.

As described earlier, this first flap 43 is positioned as shown in solid line in FIG. 4, only while the upper and the lower working units D and E are in their starting positions, and during this time, the grinding belt material 1 pushed by the first drive roll 7 is able to move over the first flap 43 to reach the top surface of the second flap 41, and further moves over the horizontal table 52 until its leading end comes to be pinched for a short length between the second drive roll 54 and the follower roll 55 disposed in the slit unit section C, whereupon it stops its forward movement. Then, a new series of preworking processes commences.

In the cutting and working section B, above the horizontal table 52, the belt hold down member 56 is swivellably supported by means of the shaft 57 and actuated by the cylinder 58 in such a way that it holds down portion 56 at the end applies appropriate downward force on the top surface of the grinding belt material 1 to prevent it from curling. Furthermore, said hold down member 56 has an arm 59*a* swivellably connected to its end by means of the pin 60, and the roller 59 is attached at the end of said arm 59*a*. This roller 59 is designed to perform an important function of preventing the trailing end of the grinding belt material 1 from moving away from its correct position by always applying an appropriate downward force thereon its own weight. There are other rollers 61, 62, etc. that similarly apply proper downward force on the top of the grinding belt material 1.

In the slit unit section C, the second drive roll 54 is driven by the reduction gearbox 63 through the chain 64 to pull the completely preworked grinding belt material 1. Next to the second drive roll 54, the lower slitting roll 65 is disposed and above the latter a plurality of slitting circular cutter 66 are disposed for slitting the grinding belt material into pieces of desired width. The slit grinding belt pieces are received by the receiving box 67. As can be seen, throughout the machine, limit switches 68 are appropriately disposed to control various automatic movements of the machine.

As can be clearly understood from the foregoing descriptions, according to the present invention, grinding belt material or the like is intermittently pulled out of the original roll unit section, cut into a desired length, its one or both ends are skived and pointed in the cutting and working unit section continuously and efficiently, and the worked material is further slit into a desired width at the slit unit section, so that the present invention is extremely valuable in saving labor in the type of operations involved.

We claim:

1. A machine for preworking overlapping abrasive coated joint comprising an original roll unit section, a cutting and working unit section, and a slit unit section, wherein in said cutting and working unit section, a horizontal table (9) has a knife blade (21) attached to its forward end, first and second flaps swivellably mounted on said cutting and working section by means of a shaft in such a way that their end portions are brought to the position flush with said knife edge and in contact therewith, a pointing plate, a belt material hold down roller is disposed on the top surface of said second flap, and furthermore, in said cutting and working unit section, an upper working unit and a lower working unit are disposed above and below said horizontal table, said upper working unit having a circular cutter for cutting the grinding belt material, a grinding wheel for skiving, and a shaving grinding belt for pointing the upper end surface of the grinding belt material, and said lower working unit having a shaving grinding belt for pointing the lower end surface of the grinding belt material which is being pinched between said second flap and said pointing plate.

* * * * *

UNITED STATES PATENT AND TRADEMARK OFFICE

CERTIFICATE OF CORRECTION

PATENT NO. : 4,008,545

DATED : February 22, 1977

INVENTOR(S) : Sakae KOIDE et al

It is certified that error appears in the above-identified patent and that said Letters Patent are hereby corrected as shown below:

In Section [73], after "Assignee:", change "Tajara" to read --Tahara--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*